US011583733B2

(12) United States Patent
Inoue et al.

(10) Patent No.: US 11,583,733 B2
(45) Date of Patent: Feb. 21, 2023

(54) GOLF BALL

(71) Applicant: SUMITOMO RUBBER INDUSTRIES, LTD., Hyogo (JP)

(72) Inventors: Hidetaka Inoue, Hyogo (JP); Kazuya Kamino, Hyogo (JP)

(73) Assignee: SUMITOMO RUBBER INDUSTRIES, LTD., Hyogo (JP)

( * ) Notice: Subject to any disclaimer, the term of this patent is extended or adjusted under 35 U.S.C. 154(b) by 166 days.

(21) Appl. No.: 16/819,282

(22) Filed: Mar. 16, 2020

(65) Prior Publication Data

US 2020/0324169 A1 Oct. 15, 2020

(30) Foreign Application Priority Data

Apr. 15, 2019 (JP) ..... JP2019-076818

(51) Int. Cl.
*A63B 37/00* (2006.01)

(52) U.S. Cl.
CPC ..... *A63B 37/0087* (2013.01); *A63B 37/0046* (2013.01); *A63B 37/0065* (2013.01); *A63B 37/0075* (2013.01); *A63B 37/0092* (2013.01)

(58) Field of Classification Search
CPC ..... A63B 37/0046; A63B 37/0043
See application file for complete search history.

(56) References Cited

U.S. PATENT DOCUMENTS

| | | | | |
|---|---|---|---|---|
| 6,514,158 | B1 * | 2/2003 | Nakamura | A63B 37/0003 473/378 |
| 9,320,943 | B1 | 4/2016 | Bartels | |
| 2004/0176185 | A1 * | 9/2004 | Morgan | A63B 37/0065 473/371 |
| 2008/0220901 | A1 * | 9/2008 | Sato | A63B 37/0012 473/376 |

(Continued)

FOREIGN PATENT DOCUMENTS

| | | |
|---|---|---|
| JP | 2018-512951 | 5/2018 |
| JP | 2018-183247 | 11/2018 |

OTHER PUBLICATIONS

Examiner's Calculations, uploaded Aug. 3, 2020, Excel Spreadsheet, 1 page.*

(Continued)

*Primary Examiner* — Eugene L Kim
*Assistant Examiner* — Matthew B Stanczak
(74) *Attorney, Agent, or Firm* — Greenblum & Bernstein, P.L.C.

(57) ABSTRACT

A golf ball includes a core, a mid layer, and a cover. A ratio R1 calculated by mathematical formula (1): R1=(Df1−Df2)/(Df2−Df3) is not less than 5.00. A ratio R2 calculated by mathematical formula (2): R2=(T2*H2)/H3 is not less than 2.00. A ratio R3 calculated by mathematical formula (3): R3=D1/T3 is less than 50. In mathematical formulas (1) to (3), Df1 represents an amount of compressive deformation of the core, Df2 represents an amount of compressive deformation of a sphere including the core and the mid layer, (Continued)

Df3 represents an amount of compressive deformation of the golf ball, T2 represents a thickness of the mid layer, H2 represents a hardness of the mid layer, H3 represents a hardness of the cover, D1 represents a diameter of the core, and T3 represents a thickness of the cover.

20 Claims, 1 Drawing Sheet

(56) References Cited

U.S. PATENT DOCUMENTS

| | | | | |
|---|---|---|---|---|
| 2011/0143861 | A1* | 6/2011 | Watanabe | A63B 37/0076 473/373 |
| 2016/0175660 | A1* | 6/2016 | Watanabe | A63B 37/0065 473/374 |
| 2016/0303431 | A1 | 10/2016 | Bartels | |
| 2016/0361605 | A1* | 12/2016 | Watanabe | A63B 37/0092 |
| 2017/0165530 | A1* | 6/2017 | Tachibana | A63B 37/0043 |
| 2017/0189765 | A1* | 7/2017 | Watanabe | A63B 37/0068 |
| 2017/0368417 | A1* | 12/2017 | Kamino | A63B 37/0017 |
| 2018/0304122 | A1* | 10/2018 | Watanabe | A63B 37/0076 |
| 2019/0217161 | A1* | 7/2019 | Watanabe | A63B 37/0019 |

OTHER PUBLICATIONS

Examiner's Calculations—version #2, uploaded Oct. 13, 2020, Excel Spreadsheet, 1 page.*
Examiner's Calc Version #3, uploaded Apr. 7, 2021, Excel Spreadsheet, 1 page.*
Examiner's Calculations #4, uploaded Jul. 20, 2021, Excel Spreadsheet, 1 page.*

* cited by examiner

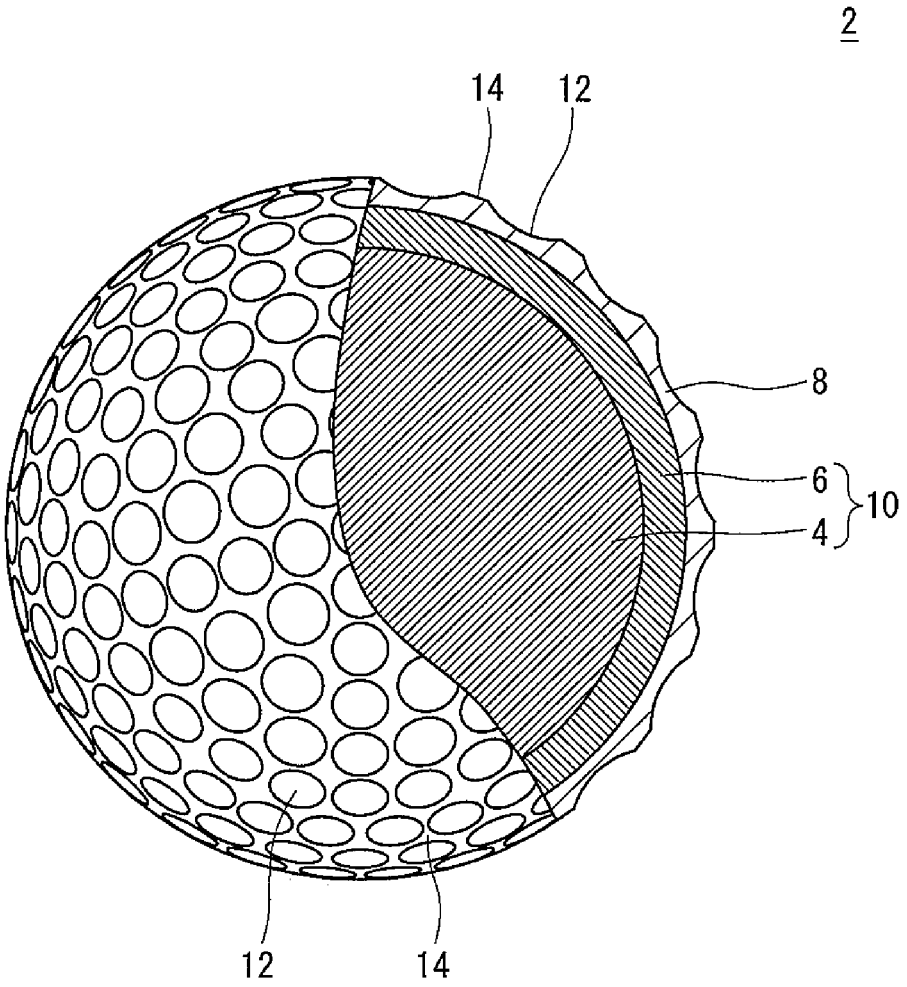
2
14
12
8
6
10
4
12
14

GOLF BALL

CROSS-REFERENCE TO RELATED APPLICATION

This application claims priority on and the benefit of Patent Application No. 2019-076818 filed in JAPAN on Apr. 15, 2019. The entire disclosures of these Japanese Patent Applications are hereby incorporated by reference.

BACKGROUND OF THE INVENTION

Field of the Invention

The present invention relates to golf balls. Specifically, the present invention relates to golf balls having a core, a mid layer, and a cover.

Description of the Related Art

The face of a golf club has a loft angle. When a golf ball is hit with the golf club, backspin due to the loft angle occurs in the golf ball. The golf ball flies with the backspin.

Golf players place importance on spin performance of golf balls. When the rate of backspin is high, the run is short. By using a golf ball having a high backspin rate, a golf player can cause the golf ball to stop at a target point. When the rate of sidespin is high, the golf ball tends to curve. By using a golf ball having a high sidespin rate, a golf player can intentionally cause the golf ball to curve. A golf ball having excellent spin performance has excellent controllability. Golf players particularly place importance on controllability upon an approach shot.

Golf players also place importance on feel at impact of a golf ball. Golf players generally prefer soft feel at impact.

JP2018-183247 discloses a golf ball having a core, a mid layer, and a cover. In the golf ball, the mid layer has a high hardness, and the cover has a low hardness. The main component of the cover is a polyurethane. The cover contributes to controllability upon an approach shot. The cover further contributes to feel at impact upon an approach shot.

JP2018-512951 discloses a golf ball having a core, a mantle layer, and a cover. The golf ball has a PGA compression of not greater than 75. The feel at impact of the golf ball is soft. In the golf ball, the main component of the cover is a polyurethane. The cover contributes to controllability upon a shot with an iron. The cover further contributes to feel at impact upon an approach shot.

Putting is important for golf players. Good putting contributes to scoring. In putting, the direction in which a golf ball is launched and the distance for which the golf ball is rolled are important. Golf players desire a golf ball that rolls for an intended distance.

Upon putting of a golf ball having a flexible cover, the distance for which the golf ball rolls may greatly deviate from the distance intended by a golf player. The distance for which the golf ball rolls tends to be shorter than the distance intended by the golf player. The phenomenon that the distance is shorter is referred to as "short". The detailed cause of a short is unknown. The low amplitude of vibration transmitted to the golf player via the golf club may be the cause of a short. The low amplitude of sound transmitted to the golf player via the air may be the cause of a short.

An object of the present invention is to provide a golf ball that has excellent controllability and feel at impact upon an approach shot and that makes it easy for a golf player to adjust a rolling distance in putting.

SUMMARY OF THE INVENTION

A golf ball according to the present invention includes a core, a mid layer positioned outside the core, and a cover positioned outside the mid layer. A ratio R1 calculated by the following mathematical formula (1) is not less than 5.00. A ratio R2 calculated by the following mathematical formula (2) is not less than 2.00. A ratio R3 calculated by the following mathematical formula (3) is less than 50.

$$R1=(Df1-Df2)/(Df2-Df3) \quad (1)$$

$$R2=(T2*H2)/H3 \quad (2)$$

$$R3=D1/T3 \quad (3)$$

In the above formulas, Df1 represents an amount of compressive deformation (mm) of the core, Df2 represents an amount of compressive deformation (mm) of a sphere including the core and the mid layer, Df3 represents an amount of compressive deformation (mm) of the golf ball, T2 represents a thickness (mm) of the mid layer, H2 represents a hardness (Shore-D) of the mid layer, H3 represents a hardness (Shore-D) of the cover, D1 represents a diameter (mm) of the core, and T3 represents a thickness (mm) of the cover.

With the golf ball according to the present invention, the cover suppresses occurrence of a slip between the face of a golf club and the golf ball. Moreover, with the golf ball, force upon hitting is efficiently converted to energy of spin. Upon an approach shot of the golf ball, the spin rate is high.

With the golf ball, the cover absorbs shock upon an approach shot. Great shock is not transmitted to a golf player who hits the golf ball.

Moreover, in putting the golf ball, the mid layer emits moderate vibration or sound.

The golf ball has excellent controllability and feel at impact upon an approach shot. Furthermore, in putting the golf ball, a golf player can easily adjust a rolling distance.

Preferably, the amount of compressive deformation Df3 of the golf ball is not less than 3.07 mm. Preferably, the amount of compressive deformation Df1 of the core is not less than 3.80 mm. Preferably, the amount of compressive deformation Df2 of the sphere including the core and the mid layer is not less than 3.30 mm.

Preferably, the hardness H2 of the mid layer is not less than 60. Preferably, the thickness T2 of the mid layer is not less than 0.9 mm. Preferably, a product (T2*H2) of the thickness T2 and the hardness H2 of the mid layer is not less than 65.0.

Preferably, the hardness H3 of the cover is not greater than 50. Preferably, the thickness T3 of the cover is not less than 0.6 mm.

Preferably, a difference (Df1−Df2) between the amount of compressive deformation Df1 and the amount of compressive deformation Df2 is not less than 0.40 mm. Preferably, a difference (Df2−Df3) between the amount of compressive deformation Df2 and the amount of compressive deformation Df3 is not greater than 0.17 mm.

Preferably, the amount of compressive deformation Df3 of the golf ball is not less than 3.29 mm and not greater than 3.52 mm. Preferably, the amount of compressive deformation Df1 of the core is not less than 4.06 mm and not greater than 4.41 mm. Preferably, the amount of compressive deformation Df2 of the sphere including the core and the mid layer is not less than 3.40 mm and not greater than 3.64 mm.

Preferably, the hardness H2 of the mid layer is not less than 60 and not greater than 70, and the thickness T2 of the mid layer is not less than 0.9 mm and not greater than 2.0 mm.

Preferably, the hardness H3 of the cover is not less than 25 and not greater than 50, and the thickness T3 of the cover is not less than 0.6 mm and not greater than 1.5 mm.

According to another aspect, a golf ball according to the present invention includes a core, a mid layer positioned outside the core, and a cover positioned outside the mid layer. A ratio R1 calculated by the following mathematical formula (1) is not less than 5.00. A ratio R2 calculated by the following mathematical formula (2) is not less than 2.00. A ratio R3 calculated by the following mathematical formula (3) is less than 50.

$$R1=(Df1-Df2)/(Df2-Df3) \quad (1)$$

$$R2=(T2*H2)/H3 \quad (2)$$

$$R3=D1/T3 \quad (3)$$

In the above formulas, Df1 represents an amount of compressive deformation (mm) of the core, Df2 represents an amount of compressive deformation (mm) of a sphere including the core and the mid layer, Df3 represents an amount of compressive deformation (mm) of the golf ball, T2 represents a thickness (mm) of the mid layer, H2 represents a hardness (Shore-D) of the mid layer, H3 represents a hardness (Shore-D) of the cover, D1 represents a diameter (mm) of the core, and T3 represents a thickness (mm) of the cover. The amount of compressive deformation Df1 of the core is not less than 3.80 mm. The amount of compressive deformation Df2 of the sphere including the core and the mid layer is not less than 3.30 mm. The amount of compressive deformation Df3 of the golf ball is not less than 3.07 mm. A difference (Df1−Df2) between the amount of compressive deformation Df1 and the amount of compressive deformation Df2 is not less than 0.40 mm. A difference (Df2−Df3) between the amount of compressive deformation Df2 and the amount of compressive deformation Df3 is not greater than 0.17 mm.

According to still another aspect, a golf ball according to the present invention includes a core, a mid layer positioned outside the core, and a cover positioned outside the mid layer. A ratio R1 calculated by the following mathematical formula (1) is not less than 5.00 and not greater than 40.00. A ratio R2 calculated by the following mathematical formula (2) is not less than 2.00 and not greater than 3.50. A ratio R3 calculated by the following mathematical formula (3) is not less than 30 and less than 50.

$$R1=(Df1-Df2)/(Df2-Df3) \quad (1)$$

$$R2=(T2*H2)/H3 \quad (2)$$

$$R3=D1/T3 \quad (3)$$

In the above formulas, Df1 represents an amount of compressive deformation (mm) of the core, Df2 represents an amount of compressive deformation (mm) of a sphere including the core and the mid layer, Df3 represents an amount of compressive deformation (mm) of the golf ball, T2 represents a thickness (mm) of the mid layer, H2 represents a hardness (Shore-D) of the mid layer, H3 represents a hardness (Shore-D) of the cover, D1 represents a diameter (mm) of the core, and T3 represents a thickness (mm) of the cover. The amount of compressive deformation Df1 of the core is not less than 3.80 mm and not greater than 4.60 mm. The amount of compressive deformation Df2 of the sphere including the core and the mid layer is not less than 3.30 mm and not greater than 4.00 mm. The amount of compressive deformation Df3 of the golf ball is not less than 3.07 mm and not greater than 3.75 mm. A difference (Df1−Df2) between the amount of compressive deformation Df1 and the amount of compressive deformation Df2 is not less than 0.40 mm and not greater than 1.00 mm. A difference (Df2−Df3) between the amount of compressive deformation Df2 and the amount of compressive deformation Df3 is not less than 0.01 mm and not greater than 0.17 mm.

BRIEF DESCRIPTION OF THE DRAWINGS

The FIGURE is a partially cutaway schematic cross-sectional view of a golf ball according to one embodiment of the present invention.

DESCRIPTION OF THE PREFERRED EMBODIMENTS

The following will describe in detail the present invention based on preferred embodiments with appropriate reference to the drawings.

A golf ball 2 shown in the FIGURE includes a spherical core 4, a mid layer 6 positioned outside the core 4, and a cover 8 positioned outside the mid layer 6. A sphere 10 including the core 4 and the mid layer 6 is referred to as an "intermediate sphere". The golf ball 2 has a plurality of dimples 12 on the surface thereof. Of the surface of the golf ball 2, a part other than the dimples 12 is a land 14. The golf ball 2 includes a paint layer and a mark layer on the external side of the cover 8, but these layers are not shown in the drawing.

The golf ball 2 preferably has a diameter D3 of not less than 40 mm and not greater than 45 mm. From the viewpoint of conformity to the rules established by the United States Golf Association (USGA), the diameter D3 is particularly preferably not less than 42.67 mm. In light of suppression of air resistance, the diameter D3 is more preferably not greater than 44 mm and particularly preferably not greater than 42.80 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

The core 4 is formed by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance of the core 4, polybutadienes are preferable. When a polybutadiene and another rubber are used in combination, it is preferred that the polybutadiene is a principal component. Specifically, the proportion of the polybutadiene to the entire base rubber is preferably not less than 50% by weight and particularly preferably not less than 80% by weight. A polybutadiene in which the proportion of cis-1,4 bonds is not less than 80% is particularly preferable.

The rubber composition of the core 4 preferably includes a co-crosslinking agent. Preferable co-crosslinking agents in light of durability and resilience performance of the golf ball 2 are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance of the core 4, zinc acrylate and zinc methacrylate are particularly preferable.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

The amount of the co-crosslinking agent per 100 parts by weight of the base rubber is preferably not less than 10 parts by weight and not greater than 45 parts by weight. The golf ball 2 in which this amount is not less than 10 parts by weight has excellent resilience performance. From this viewpoint, this amount is more preferably not less than 15 parts by weight and particularly preferably not less than 20 parts by weight. The golf ball 2 in which this amount is not greater than 45 parts by weight has excellent feel at impact. From this viewpoint, this amount is more preferably not greater than 40 parts by weight and particularly preferably not greater than 35 parts by weight.

Preferably, the rubber composition of the core 4 includes an organic peroxide. The organic peroxide serves as a crosslinking initiator. The organic peroxide contributes to the resilience performance of the core 4. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

The amount of the organic peroxide per 100 parts by weight of the base rubber is preferably not less than 0.1 parts by weight and not greater than 3.0 parts by weight. The golf ball 2 in which this amount is not less than 0.1 parts by weight has excellent resilience performance. From this viewpoint, this amount is more preferably not less than 0.3 parts by weight and particularly preferably not less than 0.5 parts by weight. The golf ball 2 in which this amount is not greater than 3.0 parts by weight has excellent feel at impact. From this viewpoint, this amount is more preferably not greater than 2.5 parts by weight and particularly preferably not greater than 2.0 parts by weight.

Preferably, the rubber composition of the core 4 includes an organic sulfur compound. The organic sulfur compound contributes to the resilience performance of the core 4. Organic sulfur compounds include naphthalenethiol compounds, benzenethiol compounds, and disulfide compounds.

Examples of naphthalenethiol compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance, the amount of the organic sulfur compound per 100 parts by weight of the base rubber is preferably not less than 0.1 parts by weight, more preferably not less than 0.2 parts by weight, and particularly preferably not less than 0.3 parts by weight. In light of soft feel at impact, the amount is preferably not greater than 1.5 parts by weight, more preferably not greater than 1.0 parts by weight, and particularly preferably not greater than 0.8 parts by weight. Two or more organic sulfur compounds may be used in combination.

The rubber composition of the core 4 may include a carboxylic acid or a carboxylate. The carboxylic acid and the carboxylate can contribute to making the hardness distribution of the core 4 appropriate. An example of preferable carboxylic acids is benzoic acid. Examples of preferable carboxylates include zinc octoate and zinc stearate. A particularly preferable compound is benzoic acid.

The rubber composition of the core 4 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the core 4 is accomplished.

The rubber composition of the core 4 may include various additives, such as sulfur, an anti-aging agent, a coloring agent, a plasticizer, a dispersant, and the like, in an adequate amount. The rubber composition may include crosslinked rubber powder or synthetic resin powder.

The core 4 preferably has a diameter D1 of not less than 35.0 mm and not greater than 40.5 mm. The golf ball 2 that includes the core 4 having a diameter D1 of not less than 35.0 mm has excellent resilience performance. From this viewpoint, the diameter D1 is more preferably not less than 36.0 mm and particularly preferably not less than 36.5 mm. The golf ball 2 that includes the core 4 having a diameter D1 of not greater than 40.5 mm has excellent durability. From this viewpoint, the diameter D1 is more preferably not greater than 40.0 mm and particularly preferably not greater than 39.5 mm.

The core 4 preferably has an amount of compressive deformation Df1 of not less than 3.80 mm. The golf ball 2 in which the amount of compressive deformation Df1 is not less than 3.80 mm has excellent feel at impact upon an approach shot. From this viewpoint, the amount of compressive deformation Df1 is more preferably not less than 3.90 mm and particularly preferably not less than 4.06 mm. In light of durability of the golf ball 2, the amount of compressive deformation Df1 is preferably not greater than 4.60 mm, more preferably not greater than 4.50 mm, and particularly preferably not greater than 4.41 mm.

The amount of compressive deformation Df1 is measured with a YAMADA type compression tester "SCH". In the measurement, the core 4 is placed on a hard plate made of metal. Next, a cylinder made of metal gradually descends toward the core 4. The core 4, squeezed between the bottom face of the cylinder and the hard plate, becomes deformed. A migration distance of the cylinder, starting from the state in which an initial load of 98 N is applied to the core 4 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s.

The core 4 preferably has a weight of not less than 10 g and not greater than 42 g. The temperature for crosslinking the core 4 is typically not lower than 140° C. and not higher than 180° C. The time period for crosslinking the core 4 is typically not shorter than 10 minutes and not longer than 60 minutes.

The mid layer 6 is positioned outside the core 4. The mid layer 6 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 that includes the mid layer 6 including an ionomer resin has excellent resilience performance. The golf ball 2 has excellent flight performance.

An ionomer resin and another resin may be used in combination. In this case, in light of resilience performance, the ionomer resin is included as the principal component of the base polymer. The proportion of the ionomer resin to the entire base polymer is preferably not less than 50% by weight.

Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. A particularly preferable ionomer resin is a copolymer formed with ethylene and acrylic acid. Another particularly preferable ionomer resin is a copolymer formed with ethylene and methacrylic acid.

In the binary copolymer and the ternary copolymer, some of the carboxyl groups are neutralized with metal ions. Examples of metal ions for use in neutralization include sodium ions, potassium ions, lithium ions, zinc ions, calcium ions, magnesium ions, aluminum ions, and neodymium ions. The neutralization may be carried out with two or more types of metal ions. Particularly suitable metal ions in light of resilience performance and durability of the golf ball 2 are sodium ions, zinc ions, lithium ions, and magnesium ions.

Specific examples of ionomer resins include trade names "Himilan 1555", "Himilan 1557", "Himilan 1605", "Himilan 1706", "Himilan 1707", "Himilan 1856", "Himilan 1855", "Himilan AM7311", "Himilan AM7315", "Himilan AM7317", "Himilan AM7329", and "Himilan AM7337", manufactured by Du Pont-MITSUI POLYCHEMICALS Co., Ltd.; trade names "Surlyn 6120", "Surlyn 6910", "Surlyn 7930", "Surlyn 7940", "Surlyn 8140", "Surlyn 8150", "Surlyn 8940", "Surlyn 8945", "Surlyn 9120", "Surlyn 9150", "Surlyn 9910", "Surlyn 9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation. Two or more ionomer resins may be used in combination.

The resin composition of the mid layer 6 may include a styrene block-containing thermoplastic elastomer. The styrene block-containing thermoplastic elastomer includes a polystyrene block as a hard segment, and a soft segment. A typical soft segment is a diene block. Examples of compounds for the diene block include butadiene, isoprene, 1,3-pentadiene, and 2,3-dimethyl-1,3-butadiene. Butadiene and isoprene are preferable. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of resilience performance of the golf ball 2, the content of the styrene component in the styrene block-containing thermoplastic elastomer is preferably not less than 10% by weight, more preferably not less than 12% by weight, and particularly preferably not less than 15% by weight. In light of feel at impact of the golf ball 2, the content is preferably not greater than 50% by weight, more preferably not greater than 47% by weight, and particularly preferably not greater than 45% by weight.

In the present invention, styrene block-containing thermoplastic elastomers include an alloy of an olefin and one or more members selected from the group consisting of SBS, SIS, SIBS, SEPS, SEPS, and SEEPS. The olefin component in the alloy is presumed to contribute to improvement of compatibility with another base polymer. The alloy can contribute to the resilience performance of the golf ball 2. An olefin having 2 to 10 carbon atoms is preferable. Examples of suitable olefins include ethylene, propylene, butene, and pentene. Ethylene and propylene are particularly preferable.

Specific examples of polymer alloys include trade names "TEFABLOC T3221C", "TEFABLOC T3339C", "TEFABLOC SJ4400N", "TEFABLOC SJ5400N", "TEFABLOC SJ6400N", "TEFABLOC SJ7400N", "TEFABLOC SJ8400N", "TEFABLOC SJ9400N", and "TEFABLOC SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "SEPTON HG-252" manufactured by Kuraray Co., Ltd.

The resin composition of the mid layer 6 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The mid layer 6 preferably has a thickness T2 of not less than 0.9 mm and not greater than 2.0 mm. In putting the golf ball 2 in which the thickness T2 is not less than 0.9 mm, a golf player can easily adjust a distance. From this viewpoint, the thickness T2 is more preferably not less than 1.0 mm and particularly preferably not less than 1.1 mm. The golf ball 2 in which the thickness T2 is not greater than 2.0 mm has excellent feel at impact. From this viewpoint, the thickness T2 is preferably not greater than 1.8 mm and particularly preferably not greater than 1.6 mm. The thickness T2 is measured at a position immediately below the land 14.

The mid layer 6 preferably has a hardness H2 of not less than 60 and not greater than 75. In putting the golf ball 2 in which the hardness H2 is not less than 60, a golf player can easily adjust a distance. From this viewpoint, the hardness H2 is more preferably not less than 62 and particularly preferably not less than 64. The golf ball 2 in which the hardness H2 is not greater than 75 has excellent feel at impact. From this viewpoint, the hardness H2 is more preferably not greater than 72 and particularly preferably not greater than 70.

The hardness H2 of the mid layer 6 is measured according to the standards of "ASTM-D 2240-68". The hardness H2 is measured with a Shore-D type hardness scale mounted to an automated hardness meter (trade name "digi test II" manufactured by Heinrich Bareiss Prüfgerätebau GmbH). For the measurement, a sheet that is formed by hot press, is formed from the same material as that of the mid layer 6, and has a thickness of about 2 mm is used. Prior to the measurement, a sheet is kept at 23° C. for two weeks. At the time of measurement, three sheets are stacked.

The product (T2*H2) of the thickness T2 (mm) and the hardness H2 (Shore-D) of the mid layer 6 is preferably not less than 65.0 and not greater than 120.0. In putting the golf ball 2 in which the product (T2*H2) is not less than 65.0, a golf player can easily adjust a distance. From this viewpoint, the product (T2*H2) is more preferably not less than 70.0 and particularly preferably not less than 74.8. The golf ball 2 in which the product (T2*H2) is not greater than 120.0 has excellent feel at impact. From this viewpoint, the product (T2*H2) is preferably not greater than 110.0 and particularly preferably not greater than 105.6.

The intermediate sphere 10 preferably has an amount of compressive deformation Df2 of not less than 3.30 mm and not greater than 4.00 mm. The golf ball 2 in which the amount of compressive deformation Df2 is not less than 3.30 mm has excellent feel at impact. From this viewpoint, the amount of compressive deformation Df2 is more preferably not less than 3.35 mm and particularly preferably not less than 3.40 mm. In putting the golf ball 2 in which the amount of compressive deformation Df2 is not greater than 4.00 mm, a golf player can easily adjust a distance. From this viewpoint, the amount of compressive deformation Df2 is more preferably not greater than 3.80 mm and particularly preferably not greater than 3.64 mm.

The amount of compressive deformation Df2 is measured with a YAMADA type compression tester "SCH". In the measurement, the intermediate sphere 10 is placed on a hard plate made of metal. Next, a cylinder made of metal gradually descends toward the intermediate sphere 10. The intermediate sphere 10, squeezed between the bottom face of the cylinder and the hard plate, becomes deformed. A migration distance of the cylinder, starting from the state in which an initial load of 98 N is applied to the intermediate sphere 10 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s.

The cover 8 is the outermost layer except for the mark layer and the paint layer. The cover 8 is formed from a resin composition. Examples of the base polymer of the resin composition include polyurethanes, ionomer resins, polyesters, polyamides, polyolefins, and polystyrenes. A preferable base polymer in light of feel at impact and spin performance is a polyurethane. When a polyurethane and another resin are used in combination for the cover 8, the proportion of the polyurethane to the entire base resin is preferably not less than 50% by weight, more preferably not less than 60% by weight, and particularly preferably not less than 70% by weight.

The resin composition of the cover 8 may include a thermoplastic polyurethane or may include a thermosetting polyurethane. In light of productivity of the golf ball 2, the thermoplastic polyurethane is preferable. The thermoplastic polyurethane includes a polyurethane component as a hard segment, and a polyester component or a polyether component as a soft segment. The thermoplastic polyurethane is flexible. The cover 8 in which the polyurethane is used has excellent scuff resistance.

The thermoplastic polyurethane has a urethane bond within the molecule. The urethane bond can be formed by reacting a polyol with a polyisocyanate. The polyol, as a material for the urethane bond, has a plurality of hydroxyl groups. Low-molecular-weight polyols and high-molecular-weight polyols can be used.

Examples of low-molecular-weight polyols include diols, triols, tetraols, and hexaols. Specific examples of diols include ethylene glycol, diethylene glycol, triethylene glycol, 1,2-propanediol, 1,3-propanediol, 2-methyl-1,3-propanediol, dipropylene glycol, 1,2-butanediol, 1,3-butanediol, 1,4-butanediol, 2,3-butanediol, 2,3-dimethyl-2,3-butanediol, neopentyl glycol, pentanediol, hexanediol, heptanediol, octanediol, and 1,6-cyclohexanedimethylol. Aniline diols or bisphenol A diols may be used. Specific examples of triols include glycerin, trimethylol propane, and hexanetriol. Specific examples of tetraols include pentaerythritol and sorbitol.

Examples of high-molecular-weight polyols include polyether polyols such as polyoxyethylene glycol (PEG), polyoxypropylene glycol (PPG), and polytetramethylene ether glycol (PTMG); condensed polyester polyols such as polyethylene adipate (PEA), polybutylene adipate (PBA), and polyhexamethylene adipate (PHMA); lactone polyester polyols such as poly-ε-caprolactone (PCL); polycarbonate polyols such as polyhexamethylene carbonate; and acrylic polyols. Two or more polyols may be used in combination. In light of feel at impact of the golf ball 2, the high-molecular-weight polyol has a number average molecular weight of preferably not less than 400 and more preferably not less than 1000. The number average molecular weight is preferably not greater than 10000.

Examples of polyisocyanates, as a material for the urethane bond, include aromatic diisocyanates, alicyclic diisocyanates, and aliphatic diisocyanates. Two or more types of diisocyanates may be used in combination.

Examples of aromatic diisocyanates include 2,4-toluene diisocyanate, 2,6-toluene diisocyanate, 4,4'-diphenylmethane diisocyanate (MDI), 1,5-naphthylene diisocyanate (NDI), 3,3'-bitolylene-4,4'-diisocyanate (TODI), xylylene diisocyanate (XDI), tetramethylxylylene diisocyanate (TMXDI), and paraphenylene diisocyanate (PPDI). One example of aliphatic diisocyanates is hexamethylene diisocyanate (HDI). Examples of alicyclic diisocyanates include 4,4'-dicyclohexylmethane diisocyanate ($H_{12}$MDI), 1,3-bis (isocyanatemethyl)cyclohexane ($H_6$XDI), isophorone diisocyanate (IPDI), and trans-1,4-cyclohexane diisocyanate (CHDI). 4,4'-dicyclohexylmethane diisocyanate is preferable.

Specific examples of the thermoplastic polyurethane include trade names "Elastollan NY80A", "Elastollan NY82A", "Elastollan NY83A", "Elastollan NY84A", "Elastollan NY85A", "Elastollan NY88A", "Elastollan NY90A", "Elastollan NY95A", "Elastollan NY97A", "Elastollan NY585", and "Elastollan KP016N", manufactured by BASF Japan Ltd.; and trade names "RESAMINE P4585LS" and "RESAMINE PS62490", manufactured by Dainichiseika Color & Chemicals Mfg. Co., Ltd.

The resin composition of the cover 8 may include a coloring agent, a filler, a dispersant, an antioxidant, an ultraviolet absorber, a light stabilizer, a fluorescent material, a fluorescent brightener, and the like in an adequate amount. When the hue of the golf ball 2 is white, a typical coloring agent is titanium dioxide.

The cover 8 preferably has a thickness T3 of not less than 0.6 mm and not greater than 1.5 mm. The golf ball 2 in which the thickness T3 is not less than 0.6 mm has excellent controllability and feel at impact upon an approach shot. From this viewpoint, the thickness T3 is more preferably not less than 0.7 mm and particularly preferably not less than 0.8 mm. In putting the golf ball 2 in which the thickness T3 is not greater than 1.5 mm, a golf player can easily adjust a distance. From this viewpoint, the thickness T3 is more preferably not greater than 1.3 mm and particularly preferably not greater than 1.2 mm. The thickness T3 is measured at a position immediately below the land 14.

The cover 8 preferably has a hardness H3 of not less than 25 and not greater than 50. The golf ball 2 in which the hardness H3 is not less than 25 has excellent durability. From this viewpoint, the hardness H3 is more preferably not less than 28 and particularly preferably not less than 31. The golf ball 2 in which the hardness H3 is not greater than 50 has excellent controllability and feel at impact upon an approach shot. From this viewpoint, the hardness H3 is more preferably not greater than 45 and particularly preferably not greater than 40.

The hardness H3 of the cover 8 is measured according to the standards of "ASTM-D 2240-68". The hardness H3 is measured with a Shore-D type hardness scale mounted to an automated hardness meter (trade name "digi test II" manufactured by Heinrich Bareiss Prüfgerätebau GmbH). For the measurement, a sheet that is formed by hot press, is formed from the same material as that of the cover 8, and has a thickness of about 2 mm is used. Prior to the measurement, a sheet is kept at 23° C. for two weeks. At the time of measurement, three sheets are stacked.

The golf ball 2 preferably has an amount of compressive deformation Df3 of not less than 3.07 mm and not greater than 3.75 mm. The golf ball 2 having an amount of compressive deformation Df3 of not less than 3.07 mm has excellent controllability and feel at impact upon an approach shot. From this viewpoint, the amount of compressive deformation Df3 is more preferably not less than 3.20 mm and particularly preferably not less than 3.29 mm. In putting the golf ball 2 having an amount of compressive deformation Df3 of not greater than 3.75 mm, a golf player can easily adjust a distance. From this viewpoint, the amount of compressive deformation Df3 is more preferably not greater than 3.60 mm and particularly preferably not greater than 3.52 mm.

The amount of compressive deformation Df3 is measured with a YAMADA type compression tester "SCH". In the measurement, the golf ball 2 is placed on a hard plate made of metal. Next, a cylinder made of metal gradually descends toward the golf ball 2. The golf ball 2, squeezed between the bottom face of the cylinder and the hard plate, becomes deformed. A migration distance of the cylinder, starting from the state in which an initial load of 98 N is applied to the golf ball 2 up to the state in which a final load of 1274 N is applied thereto, is measured. A moving speed of the cylinder until the initial load is applied is 0.83 mm/s. A moving speed of the cylinder after the initial load is applied until the final load is applied is 1.67 mm/s.

The golf ball 2 may include a reinforcing layer between the mid layer 6 and the cover 8. The reinforcing layer firmly adheres to the mid layer 6 and also to the cover 8. The reinforcing layer suppresses separation of the cover 8 from the mid layer 6. The reinforcing layer is formed from a resin composition. Examples of a preferable base polymer of the reinforcing layer include two-component curing type epoxy resins and two-component curing type urethane resins. The reinforcing layer preferably has a thickness of not less than 5 μm and not greater than 30 μm.

A ratio R1, of the golf ball 2, calculated by mathematical formula (1) is not less than 5.00.

$$R1=(Df1-Df2)/(Df2-Df3) \quad (1)$$

In the golf ball 2, the difference (Df1−Df2) between the amount of compressive deformation Df1 of the core 4 and the amount of compressive deformation Df2 of the intermediate sphere 10 is sufficiently large, and the difference (Df2−Df3) between the amount of compressive deformation Df2 of the intermediate sphere 10 and the amount of compressive deformation Df3 of the golf ball 2 is sufficiently small.

During putting of the golf ball 2 in which the difference (Df1−Df2) is large, the mid layer 6 emits moderate vibration or sound. In putting the golf ball 2, a golf player can easily adjust a distance.

Upon an approach shot of the golf ball 2 in which the difference (Df2−Df3) is small, force is sufficiently transmitted to the inside of the golf ball 2. With the golf ball 2, force upon hitting is efficiently converted to kinetic energy of spin. The golf ball 2 has excellent controllability upon an approach shot.

The golf ball 2 in which the ratio R1 is not less than 5.00 not only has excellent controllability and feel at impact upon an approach shot, but also has excellent putting performance. From this viewpoint, the ratio R1 is more preferably not less than 5.10 and particularly preferably not less than 5.15. In light of ease of production of the golf ball 2, the ratio R1 is preferably not greater than 40.00.

From the viewpoint that a golf player can easily adjust a distance in putting, the difference (Df1−Df2) is preferably not less than 0.40 mm, more preferably not less than 0.50 mm, and particularly preferably not less than 0.60 mm. In light of ease of production of the golf ball 2, the difference (Df1−Df2) is preferably not greater than 1.00 mm.

In light of controllability upon an approach shot, the difference (Df2−Df3) is preferably not greater than 0.17 mm, more preferably not greater than 0.15 mm, and particularly preferably not greater than 0.13 mm. In light of ease of production of the golf ball 2, the difference (Df2−Df3) is preferably not less than 0.01 mm.

A ratio R2, of the golf ball 2, calculated by mathematical formula (2) is not less than 2.00.

$$R2=(T2*H2)/H3 \quad (2)$$

In the golf ball 2, the product (T2*H2) of the thickness T2 and the hardness H2 of the mid layer 6 is sufficiently high, and the hardness H3 of the cover 8 is sufficiently low.

During putting of the golf ball 2 in which the product (T2*H2) is high, the mid layer 6 emits moderate vibration or sound. In putting the golf ball 2, a golf player can easily adjust a distance.

Upon an approach shot of the golf ball 2 in which the hardness H3 is low, the cover 8 suppresses occurrence of a slip between the face of a golf club and the golf ball 2. Upon an approach shot of the golf ball 2, the spin rate is high. The golf ball 2 has excellent controllability upon an approach shot.

Upon an approach shot of the golf ball 2 in which the hardness H3 is low, the cover 8 absorbs shock. Upon an approach shot of the golf ball 2, the shock transmitted to a golf player is small.

The golf ball 2 in which the ratio R2 is not less than 2.00 has excellent putting performance and also has excellent controllability and feel at impact upon an approach shot. From this viewpoint, the ratio R2 is more preferably not less than 2.10 and particularly preferably not less than 2.15. In light of durability of the golf ball 2, the ratio R2 is preferably not greater than 3.50.

A ratio R3, of the golf ball 2, calculated by mathematical formula (3) is less than 50.

$$R3=D1/T3 \quad (3)$$

In the golf ball 2, the diameter D1 of the core 4 is small, and the thickness T3 of the cover 8 is large.

Upon an approach shot of the golf ball 2 in which the ratio R3 is less than 50, the cover 8 suppresses occurrence of a slip between the face of a golf club and the golf ball 2. Upon an approach shot of the golf ball 2, the spin rate is high. The golf ball 2 has excellent controllability upon an approach shot.

In light of controllability, the ratio R3 is particularly preferably not greater than 48. In light of resilience performance of the golf ball 2, the ratio R3 is preferably not less than 30.

EXAMPLES

The following will show the effects of the present invention by means of Examples, but the present invention should not be construed in a limited manner on the basis of the description of these Examples.

Example 1

A rubber composition A was obtained by kneading 100 parts by weight of a high-cis polybutadiene (trade name "BR-730", manufactured by JSR Corporation), 24.8 parts by weight of zinc diacrylate, 5 parts by weight of zinc oxide, an appropriate amount of barium sulfate, 0.3 parts by weight of pentabromo diphenyl disulfide, and 0.8 parts by weight of dicumyl peroxide. The rubber composition A was placed into a mold including upper and lower mold halves each having a hemispherical cavity, and heated to obtain a core with a diameter of 38.5 mm. The amount of barium sulfate was adjusted such that a core having a predetermined weight was obtained.

A resin composition a was obtained by kneading 50 parts by weight of an ionomer resin (the aforementioned "Himilan 1605"), 50 parts by weight of another ionomer resin (the aforementioned "Himilan AM7329"), and 4 parts by weight of titanium dioxide with a twin-screw kneading extruder. The core was placed into a mold including upper and lower mold halves each having a hemispherical cavity. The core was covered with the resin composition a by injection molding to form a mid layer. The thickness of the mid layer was 1.3 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the mid layer with a spray gun, and kept at 23° C. for 12 hours to obtain a reinforcing layer. The thickness of the reinforcing layer was 10 μm.

A resin composition e was obtained by kneading 100 parts by weight of a thermoplastic polyurethane elastomer (the aforementioned "Elastollan NY84A"), 0.2 parts by weight of a light stabilizer (trade name "TINUVIN 770"), and 4 parts by weight of titanium dioxide with a twin-screw kneading extruder. A sphere having the core, the mid layer, and the reinforcing layer was placed into a final mold that includes upper and lower mold halves each having a hemispherical cavity and having a large number of pimples on its cavity face. The sphere was covered with the resin composition e by injection molding to form a cover. The thickness of the cover was 0.8 mm. Dimples having a shape that is the inverted shape of the pimples were formed on the cover.

A clear paint including a two-component curing type polyurethane as a base material was applied to this outer cover to obtain a golf ball of Example 1 with a diameter of about 42.7 mm and a weight of about 45.3 g.

Examples 2 to 9 and Comparative Examples 1 to 7

Golf balls of Examples 2 to 9 and Comparative Examples 1 to 7 were obtained in the same manner as Example 1, except the specifications of the core, the mid layer, and the cover were set as shown in Tables 4 to 7 below. The composition of the core is shown in detail in Table 1 below. The composition of the mid layer is shown in detail in Table 2 below. The composition of the cover is shown in detail in Table 3 below.

[Controllability]

A sand wedge (trade name "CG15 Forged Wedge", manufactured by Roger Cleveland Golf Company, Inc., loft angle: 52.0°) was attached to a swing machine manufactured by Golf Laboratories, Inc. A golf ball was hit under the condition of a head speed of 16 m/sec, and the spin rate immediately after the hit was measured. The measurement was conducted 12 times, and the average of the obtained data was calculated. The results are shown as differences from the result of Example 1 in Tables 4 to 7 below.

[Feel at Impact]

Ten testers hit golf balls with wedges and were asked about feel at impact. The evaluation was categorized as follows on the basis of the number of golf players who answered that "the feel at impact was good".

A: 8 or more

B: 6 to 7

C: 4 to 5

D: 3 or less

The results are shown in Tables 4 to 7 below.

[Putting Performance]

Ten testers each putted eight golf balls toward a target 15 m away from the tester. The distance between the target and the position at which each golf ball stopped was measured. The average of the data of the distances is shown in Tables 4 to 7 below. In the case of being short with respect to the target, the result is indicated with "−", and, in the case of being over the target, the result is indicated with "+".

TABLE 1

Composition of Core (parts by weight)

| Core composition | A | B | C | D |
|---|---|---|---|---|
| Polybutadiene | 100 | 100 | 100 | 100 |
| Zinc diacrylate | 24.8 | 22.5 | 20.8 | 23.6 |
| Zinc oxide | 5 | 5 | 5 | 5 |
| Barium sulfate | A.A. | A.A. | A.A. | A.A. |
| Pentabromo diphenyl disulfide | 0.3 | 0.3 | 0.3 | 0.3 |
| Dicumyl peroxide | 0.8 | 0.8 | 0.8 | 0.8 |

A.A.: Adjusted such that the weight of the golf ball was 45.3 g.

TABLE 2

Composition of Mid Layer (parts by weight)

| | a | b | c | d |
|---|---|---|---|---|
| Surlyn 8150 | — | 50 | — | — |
| Himilan 1605 | 50 | — | 47 | — |
| Himilan AM7329 | 50 | 50 | 50 | — |
| Himilan 1555 | — | — | — | 45 |
| Himilan 1557 | — | — | — | 45 |
| TEFABLOC T3221C | — | — | 3 | 10 |
| Titanium dioxide | 4 | 4 | 4 | 4 |
| Hardness (Shore-D) | 66 | 68 | 63 | 55 |

TABLE 3

Composition of Cover (parts by weight)

| | e | f | g | h |
|---|---|---|---|---|
| Elastollan NY84A | 100 | — | — | — |
| Elastollan NY88A | — | 100 | 50 | — |
| Elastollan NY95A | — | — | 50 | — |
| Himilan 1555 | — | — | — | 41 |
| Himilan 1557 | — | — | — | 41 |
| TEFABLOC T3221C | — | — | — | 18 |
| TINUVIN 770 | 0.2 | 0.2 | 0.2 | — |
| Titanium dioxide | 4 | 4 | 4 | 4 |
| Hardness (Shore-D) | 31 | 36 | 40 | 50 |

TABLE 4

Evaluation Results

| | Ex. 1 | Ex . 2 | Ex. 3 | Ex. 4 |
|---|---|---|---|---|
| Core | A | B | B | C |
| Diameter D1 (mm) | 38.5 | 38.5 | 37.7 | 37.9 |
| Compression Df1 (mm) | 4.06 | 4.28 | 4.32 | 4.41 |
| Mid layer | a | b | a | a |
| Thickness T2 (mm) | 1.3 | 1.3 | 1.3 | 1.6 |
| Hardness H2 (Shore-D) | 66 | 68 | 66 | 66 |
| T2 * H2 | 85.8 | 88.4 | 85.8 | 105.6 |
| Compression Df2 (mm) | 3.46 | 3.59 | 3.64 | 3.52 |
| Cover | e | e | e | e |
| Thickness T3 (mm) | 0.8 | 0.8 | 1.2 | 0.8 |
| Hardness H3 (Shore-D) | 31 | 31 | 31 | 31 |
| Compression Df3 (mm) | 3.37 | 3.50 | 3.52 | 3.43 |
| Df1 − Df2 | 0.60 | 0.69 | 0.68 | 0.89 |
| Df2 − Df3 | 0.09 | 0.09 | 0.12 | 0.09 |
| (Df1 − Df2)/(Df2 − Df3) | 6.67 | 7.67 | 5.67 | 9.89 |
| (T2 * H2)/H3 | 2.77 | 2.85 | 2.77 | 3.41 |
| D1/T3 | 48 | 48 | 31 | 47 |
| SW spin (rpm) | 140 | 100 | 240 | 120 |
| SW feel at impact | B | B | A | B |
| Putting | +1.2 | +1.8 | −0.8 | +1.6 |

TABLE 5

Evaluation Results

| | Ex. 5 | Ex. 6 | Ex. 7 | Ex . 8 |
|---|---|---|---|---|
| Core | C | C | B | B |
| Diameter D1 (mm) | 37.9 | 37.1 | 38.1 | 38.1 |
| Compression Df1 (mm) | 4.41 | 4.37 | 4.29 | 4.29 |
| Mid layer | a | a | b | a |
| Thickness T2 (mm) | 1.6 | 1.6 | 1.1 | 1.3 |
| Hardness H2(Shore-D) | 66 | 66 | 68 | 66 |
| T2 * H2 | 105.6 | 105.6 | 74.8 | 85.8 |
| Compression Df2 (mm) | 3.52 | 3.48 | 3.60 | 3.57 |
| Cover | f | f | e | g |
| Thickness T3 (mm) | 0.8 | 1.2 | 1.2 | 1.0 |
| Hardness H3(Shore-D) | 36 | 36 | 31 | 40 |
| Compression Df3 (mm) | 3.41 | 3.35 | 3.48 | 3.44 |
| Df1 − Df2 | 0.89 | 0.89 | 0.69 | 0.72 |
| Df2 − Df3 | 0.11 | 0.13 | 0.12 | 0.13 |
| (Df1 − Df2)/(Df2 − Df3) | 8.09 | 6.85 | 5.75 | 5.54 |
| (T2 * H2)/H3 | 2.93 | 2.93 | 2.41 | 2.15 |
| D1/T3 | 47 | 31 | 32 | 38 |
| SW spin (rpm) | 80 | 210 | 250 | 60 |
| SW feel at impact | B | A | A | B |
| Putting | +1.9 | −0.5 | −1.4 | +0.8 |

TABLE 6

Evaluation Results

| | Ex. 9 | Comp. Ex . 1 | Comp. Ex. 2 | Comp. Ex. 3 |
|---|---|---|---|---|
| Core | D | A | B | A |
| Diameter D1 (mm) | 37.5 | 38.9 | 38.9 | 38.9 |
| Compression Df1 (mm) | 4.16 | 4.03 | 4.26 | 4.03 |
| Mid layer | a | d | a | c |
| Thickness T2 (mm) | 1.6 | 1.3 | 1.3 | 1.3 |
| Hardness H2(Shore-D) | 66 | 55 | 66 | 63 |
| T2 * H2 | 105.6 | 71.5 | 85.8 | 81.9 |
| Compression Df2 (mm) | 3.40 | 3.67 | 3.58 | 3.62 |
| Cover | e | e | h | g |
| Thickness T3 (mm) | 1.0 | 0.6 | 0.6 | 0.6 |
| Hardness H3(Shore-D) | 31 | 31 | 50 | 40 |
| Compression Df3 (mm) | 3.29 | 3.60 | 3.47 | 3.54 |
| Df1 − Df2 | 0.76 | 0.36 | 0.68 | 0.41 |
| Df2 − Df3 | 0.11 | 0.07 | 0.11 | 0.08 |
| (Df1 − Df2)/(Df2 − Df3) | 6.91 | 5.14 | 6.18 | 5.13 |
| (T2 * H2)/H3 | 3.41 | 2.31 | 1.72 | 2.05 |

TABLE 6-continued

| Evaluation Results | | | | |
|---|---|---|---|---|
| | Ex. 9 | Comp. Ex . 1 | Comp. Ex. 2 | Comp. Ex. 3 |
| D1/T3 | 38 | 65 | 65 | 65 |
| SW spin (rpm) | 180 | 0 | −230 | −100 |
| SW feel at impact | A | C | D | C |
| Putting | −1.1 | −2.8 | −2.0 | −2.3 |

TABLE 7

| Evaluation Results | | | | |
|---|---|---|---|---|
| | Comp. Ex. 4 | Comp. Ex. 5 | Comp. Ex. 6 | Comp. Ex. 7 |
| Core | A | A | B | A |
| Diameter D1 (mm) | 39.5 | 38.9 | 39.5 | 38.5 |
| Compression Df1 (mm) | 4.00 | 4.03 | 4.23 | 4.06 |
| Mid layer | c | d | a | c |
| Thickness T2 (mm) | 1.0 | 1.3 | 1.3 | 1.3 |
| Hardness H2(Shore-D) | 63 | 55 | 66 | 63 |
| T2 * H2 | 63.0 | 71.5 | 85.8 | 81.9 |
| Compression Df2 (mm) | 3.69 | 3.67 | 3.57 | 3.69 |
| Cover | g | g | e | h |
| Thickness T3 (mm) | 0.6 | 0.6 | 0.3 | 0.8 |
| Hardness H3(Shore-D) | 40 | 40 | 31 | 50 |
| Compression Df3 (mm) | 3.61 | 3.58 | 3.54 | 3.54 |
| Df1 − Df2 | 0.31 | 0.36 | 0.66 | 0.37 |
| Df2 − Df3 | 0.08 | 0.09 | 0.03 | 0.15 |
| (Df1 − Df2)/(Df2 − Df3) | 3.88 | 4.00 | 22.00 | 2.47 |
| (T2 * H2)/H3 | 1.58 | 1.79 | 2.77 | 1.64 |
| D1/T3 | 66 | 65 | 132 | 48 |
| SW spin (rpm) | −70 | −60 | −80 | −320 |
| SW feel at impact | C | C | D | D |
| Putting | −2.4 | −2.9 | +2.8 | +2.1 |

As shown in Tables 4 to 7, the golf ball of each Example has excellent controllability and feel at impact upon an approach shot and has excellent putting performance. From the evaluation results, advantages of the present invention are clear.

The golf ball according to the present invention is suitable for, for example, playing golf on golf courses and practicing at driving ranges. The above descriptions are merely illustrative examples, and various modifications can be made without departing from the principles of the present invention.

What is claimed is:

1. A golf ball comprising a core, a mid layer positioned outside the core, and a cover positioned outside the mid layer, wherein a ratio R1 calculated by the following mathematical formula (1) is not less than 5.00, a ratio R2 calculated by the following mathematical formula (2) is not less than 2.00, and a ratio R3 calculated by the following mathematical formula (3) is less than 50, $$R1=(Df1-Df2)/(Df2-Df3) \quad (1)$$

$$R2=(T2*H2)/H3 \quad (2)$$

$$R3=D1/T3 \quad (3)$$

wherein

Df1 represents an amount of compressive deformation (mm) of the core,

Df2 represents an amount of compressive deformation (mm) of a sphere including the core and the mid layer, Df3 represents an amount of compressive deformation (mm) of the golf ball, T2 represents a thickness (mm) of the mid layer, H2 represents a hardness (Shore-D) of the mid layer, H3 represents a hardness (Shore-D) of the cover, D1 represents a diameter (mm) of the core, T3 represents a thickness (mm) of the cover, a difference (Df2−Df3) between the amount of compressive deformation Df2 and the amount of compressive deformation Df3 is 0.13 mm or less, and Df1, Df2, and Df3 are measured according to a compression test including application of an initial load of 98N and a final load of 1274N.

2. The golf ball according to claim 1, wherein the amount of compressive deformation Df3 of the golf ball is not less than 3.07 mm.

3. The golf ball according to claim 1, wherein the amount of compressive deformation Df1 of the core is not less than 3.80 mm.

4. The golf ball according to claim 1, wherein the amount of compressive deformation Df2 of the sphere including the core and the mid layer is not less than 3.30 mm.

5. The golf ball according to claim 1, wherein the hardness H2 of the mid layer is not less than 60.

6. The golf ball according to claim 1, wherein the thickness T2 of the mid layer is not less than 0.9 mm.

7. The golf ball according to claim 1, wherein a product (T2*H2) of the thickness T2 and the hardness H2 of the mid layer is not less than 65.0.

8. The golf ball according to claim 1, wherein the hardness H3 of the cover is not greater than 50.

9. The golf ball according to claim 1, wherein the thickness T3 of the cover is not less than 0.6 mm.

10. The golf ball according to claim 1, wherein a difference (Df1−Df2) between the amount of compressive deformation Df1 and the amount of compressive deformation Df1 is not less than 0.40 mm.

11. The golf ball according to claim 1, wherein the amount of compressive deformation Df3 of the golf ball is not less than 3.29 mm and not greater than 3.52 mm.

12. The golf ball according to claim 1, wherein the amount of compressive deformation Df1 of the core is not less than 4.06 mm and not greater than 4.41 mm.

13. The golf ball according to claim 1, wherein the amount of compressive deformation Df2 of the sphere including the core and the mid layer is not less than 3.40 mm and not greater than 3.64 mm.

14. The golf ball according to claim 1, wherein the hardness H2 of the mid layer is not less than 60 and not greater than 70, and the thickness T2 of the mid layer is not less than 0.9 mm and not greater than 2.0 mm.

15. The golf ball according to claim 1, wherein the hardness H3 of the cover is not less than 25 and not greater than 50, and the thickness T3 of the cover is not less than 0.6 mm and not greater than 1.5 mm.

16. The golf ball according to claim 1, wherein the difference (Df2−Df3) between the amount of compressive deformation Df2 and the amount of compressive deformation Df3 is not less than 0.11 mm and not greater than 0.13 mm.

17. The golf ball according to claim 1, wherein the difference (Df2−Df3) between the amount of compressive deformation Df2 and the amount of compressive deformation Df3 is not less than 0.11 mm and not greater than 0.12 mm.

18. The golf ball according to claim 1, wherein the difference (Df2−Df3) between the amount of compressive deformation Df2 and the amount of compressive deformation Df3 is 0.12 mm.

19. A golf ball comprising a core, a mid layer positioned outside the core, and a cover positioned outside the mid layer, wherein a ratio R1 calculated by the following mathematical formula (1) is not less than 5.00, a ratio R2 calculated by the following mathematical formula (2) is not less than 2.00, a ratio R3 calculated by the following mathematical formula (3) is less than 50, $$R1=(Df1-Df2)/(Df2-Df3) \quad (1)$$

$$R2=(T2*H2)/H3 \quad (2)$$

$$R3=D1/T3 \quad (3)$$

wherein

Df1 represents an amount of compressive deformation (mm) of the core,

Df2 represents an amount of compressive deformation (mm) of a sphere including the core and the mid layer, Df3 represents an amount of compressive deformation (mm) of the golf ball, T2 represents a thickness (mm) of the mid layer, H2 represents a hardness (Shore-D) of the mid layer, H3 represents a hardness (Shore-D) of the cover, D1 represents a diameter (mm) of the core, T3 represents a thickness (mm) of the cover, Df1, Df2, and Df3 are measured according to a compression test including application of an initial load of 98N and a final load of 1274N, the amount of compressive deformation Df1 of the core is not less than 3.80 mm, the amount of compressive deformation Df2 of the sphere including the core and the mid layer is not less than 3.30 mm, the amount of compressive deformation Df3 of the golf ball is not less than 3.07 mm, a difference (Df1−Df2) between the amount of compressive deformation Df1 and the amount of compressive deformation Df2 is not less than 0.40 mm, and a difference (Df2−Df3) between the amount of compressive deformation Df2 and the amount of compressive deformation Df3 is not greater than 0.13 mm.

20. A golf ball comprising a core, a mid layer positioned outside the core, and a cover positioned outside the mid layer, wherein a ratio R1 calculated by the following mathematical formula (1) is not less than 5.00 and not greater than 40.00, a ratio R2 calculated by the following mathematical formula (2) is not less than 2.00 and not greater than 3.50, a ratio R3 calculated by the following mathematical formula (3) is not less than 30 and less than 50, $$R1=(Df1-Df2)/(Df2-Df3) \quad (1)$$

$$R2=(T2*H2)/H3 \quad (2)$$

$$R3=D1/T3 \quad (3)$$

wherein

Df1 represents an amount of compressive deformation (mm) of the core,

Df2 represents an amount of compressive deformation (mm) of a sphere including the core and the mid layer, Df3 represents an amount of compressive deformation (mm) of the golf ball, T2 represents a thickness (mm) of the mid layer, H2 represents a hardness (Shore-D) of the mid layer, H3 represents a hardness (Shore-D) of the cover, D1 represents a diameter (mm) of the core, T3 represents a thickness (mm) of the cover, Df1, Df2, and Df3 are measured according to a compression test including application of an initial load of 98N and a final load of 1274N, the amount of compressive deformation Df1 of the core is not less than 3.80 mm and not greater than 4.60 mm, the amount of compressive deformation Df2 of the sphere including the core and the mid layer is not less than 3.30 mm and not greater than 4.00 mm, the amount of compressive deformation Df3 of the golf ball is not less than 3.07 mm and not greater than 3.75 mm, a difference (Df1−Df2) between the amount of compressive deformation Df1 and the amount of compressive deformation Df2 is not less than 0.40 mm and not greater than 1.00 mm, and a difference (Df2−Df3) between the amount of compressive deformation Df2 and the amount of compressive deformation Df3 is not less than 0.01 mm and not greater than 0.13 mm.

* * * * *